United States Patent [19]

Schwerdt et al.

[11] Patent Number: 4,813,601

[45] Date of Patent: Mar. 21, 1989

[54] PIEZOELECTRIC CONTROL VALVE FOR CONTROLLING FUEL INJECTION VALVE IN INTERNAL-COMBUSTION ENGINES

[75] Inventors: Paul Schwerdt, Freudenstadt; Karl Kirschenhofer, Ulm, both of Fed. Rep. of Germany

[73] Assignee: Daimler-Benz Aktiengesellschaft, Stuttgart, Fed. Rep. of Germany

[21] Appl. No.: 156,447

[22] Filed: Feb. 16, 1988

[30] Foreign Application Priority Data

Feb. 14, 1987 [DE] Fed. Rep. of Germany ..... 3704741

[51] Int. Cl.[4] ..... F02M 47/00

[52] U.S. Cl. ..... 239/91; 239/93; 239/124; 123/446; 310/328

[58] Field of Search ..... 239/88–95, 239/124, 125, 585; 123/446, 506; 310/328

[56] References Cited

U.S. PATENT DOCUMENTS 1,341,911 6/1920 Keller ..... 239/88
3,501,099 3/1970 Benson ..... 239/585
4,579,283 4/1986 Igashira et al. ..... 239/88

FOREIGN PATENT DOCUMENTS 2028442 12/1971 Fed. Rep. of Germany .
3418707 10/1985 Fed. Rep. of Germany .

*Primary Examiner*—Andres Kashnikow
*Assistant Examiner*—Mary Beth O. Jones
*Attorney, Agent, or Firm*—Barnes & Thornburg

[57] ABSTRACT

A piezoelectric control valve, for motor fuel injection via an injection valve, includes a hydraulic play-compensation element inside the control valve on the one side, which automatically compensates for possible changes in length of the reference system as a result of piezoceramic setting actions in the piezoelectric actuator so that, at the same working stroke of the piezoelectric actuator, an identical stroke at the valve is also always ensured. A hydraulic stroke transmission inside the control valve on the other side, provide a valve stroke corresponding to a multiple of the working stroke.

18 Claims, 4 Drawing Sheets

PIEZOELECTRIC CONTROL VALVE FOR CONTROLLING FUEL INJECTION VALVE IN INTERNAL-COMBUSTION ENGINES

BACKGROUND AND SUMMARY OF THE INVENTION

The invention relates generally to piezoelectric control valves and more specifically to an automatically compensating piezoelectric control valve.

A piezoelectric control valve for controlling the motor fuel injection via an injection valve is shown in U.S. Pat. No. 3,501,099 in FIG. 5. Since the working stroke of a piezoceramic column, at a justifiable overall length, is relatively small for physical reasons, this control valve, to increase the valve stroke, has a stroke transmission which is formed by a tappet cylinder. The tappet cylinder can be moved by the piezoelectric actuator, interacting with a valve piston of the valve via a fluid located in a chamber. The end face of the valve piston is made smaller than the end face of the tappet cylinder.

Moreover, on account of the rough environment in which the piezoelectric control valves are used, hydraulic forces, temperature changes and also depolarizing actions can cause changes in length of the piezoceramic columns, but with the working stroke being fully maintained.

From this it is apparent that at such a relatively small working stroke, the control valve arrangement will react very sensitively to a setting action of the piezoceramic and at the control valve, the valve gap must be made exactly true to size so that the gap can be closed or opened at a given working stroke.

Thus, with regard to compensation of play, a valve drive for controlling internal-combustion engines has been disclosed in German Offenlegungsschrift No. 3,418,707. A hydraulic play-compensation element is arranged in the direction of the lines of force between a cam of a cam shaft and a valve piston of a gas change valve in order to ensure that play occurring at the cam and/or at the cup-type tappet interacting with it on account of wear phenomena is always compensated.

Thus, it is an object of the invention to make, while maintaining the working stroke, a piezoelectric control valve, having a stroke transmission, that automatically compensates to maintain a constant valve stroke for any changes in length which may occur in the piezoelectric actuator forming the reference system.

These and other objects are achieved by providing a hydraulic play-compensation device connect to a fluid chamber between a valve piston which moves a control valve to open an injection valve and a tappet cylinder which is moved by the piezoelectric actuator to equalize pressure in the chamber resulting from changes in volume of the chamber during the return stroke. The relation ship between the valve piston and the tappet cylinder produces the stroke transmission, The hydraulic play-compensation element includes a spring loaded ball or check valve connected to the stroke transmission fluid chamber to create a path allowing refilling of the stroke transmission fluid chamber when the stroke of the tappet cylinder has been extended in the return direction because of a shortening of the piezoelectric drive element. Once the pressures are equalized, the ball valve closes thereby compensating the piezoelectric control valve. Small restrictive passages or gaps are Parallel to the ball valve to relieve high pressure in the stroke transmission fluid chamber which results from a reduced stroke of the tappet cylinder produced by an increase in the length of the piezoelectric actuator. The hydraulic play-compensation element is operable with Piezoelectric control valves wherein the piezoelectric actuator and the valve body move in the same or opposite directions.

Other objects, advantages and novel features of the Present invention will become apparent from the following detailed description of the invention when considered in conjunction with the accompanying drawings.

DETAILED DESCRIPTION OF THE DRAWINGS

Figure 1:
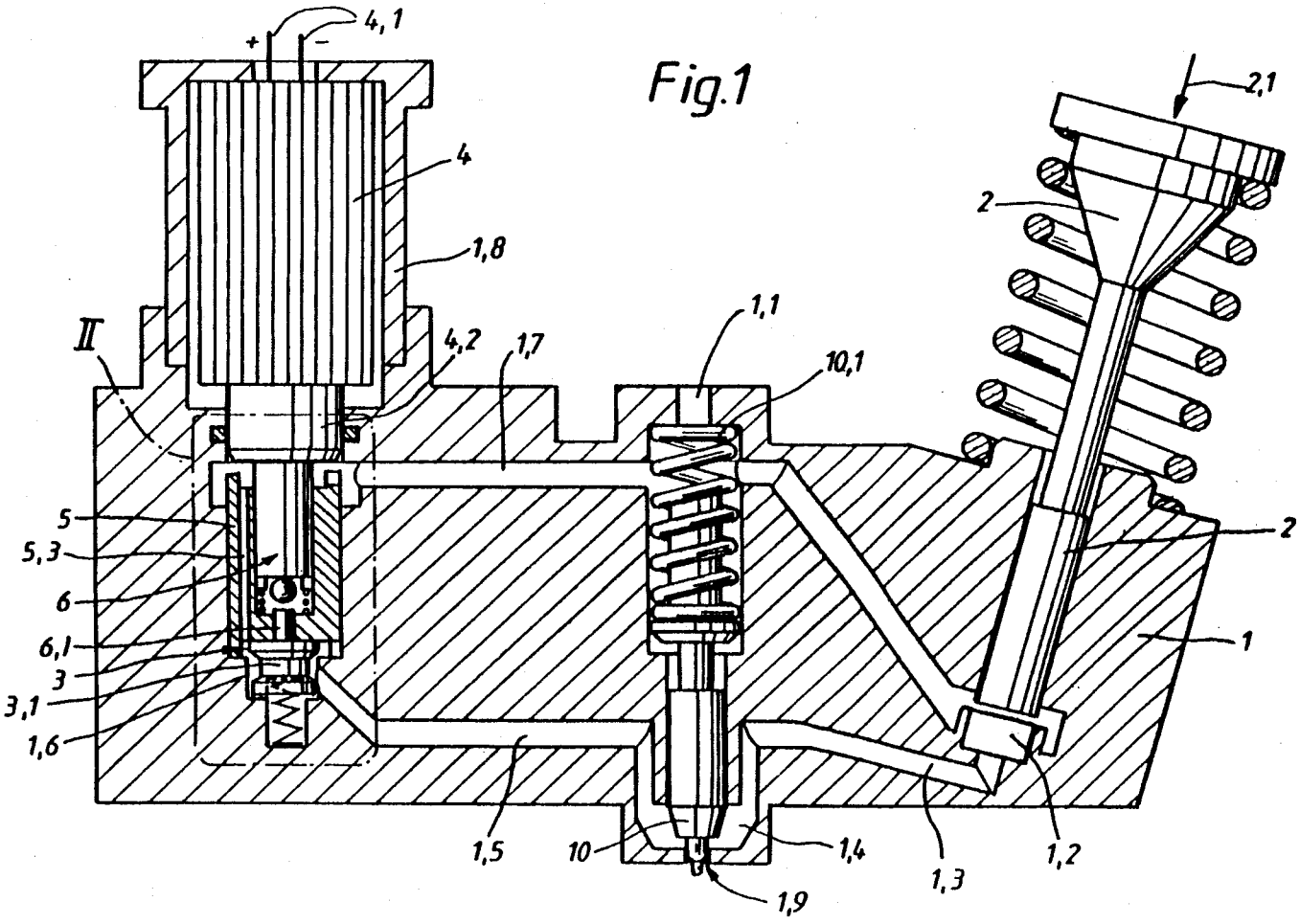
FIG. 1 is a cross-sectional view of a piezoelectric control valve according to the principles of the present invention arranged in a pump-nozzle unit of an injection device.

As illustrated in FIG. 1, motor fuel passes from a motor fuel supply (not shown) through a bore 1.1 in the housing 1 into a space 1.2. A pump plunger 2 can be moved in the direction 2.1 by an actuating device (not shown). At the same time, the motor fuel is delivered through a housing channel 1.3 into a nozzle space 1.4 and further through a fluid channel 1.5 into a space 1.6 of the housing 1 and from there back into the return fluid channel 1.7 via a valve 3. In an axial elongation of the space 1.6, the housing 1 has an extension 1.8 in which a piezoelectric actuator 4 is arranged and which is connected to an impulse generator (not shown) via electrical connection lines 4.1. Moreover, arranged in an axially movable manner in the housing 1 as an axial elongation of the bore 1.1 is a nozzle needle 10 which protrudes into the nozzle space 1.4. Under the action of a spring 10.1, the nozzle needle 1.4 seals via its sealing seat an injection bore 1.9 in the housing 1 leading from the nozzle space 1.4 into a combustion chamber (not shown).

Firmly inserted in the space 1.6 of the housing 1 is a guide sleeve 5 which serves as an abutment for the spring-loaded valve body 3.1 and for accommodating and guiding a play-compensation element 6 and a valve piston 6.1. Channels 5.3 are provided in the guide sleeve 5 so that the motor fuel can flow from the fluid channel 1.5 into the space 1.6 and via the channels 5.3 into the return fluid channel 1.7.

Figure 2:
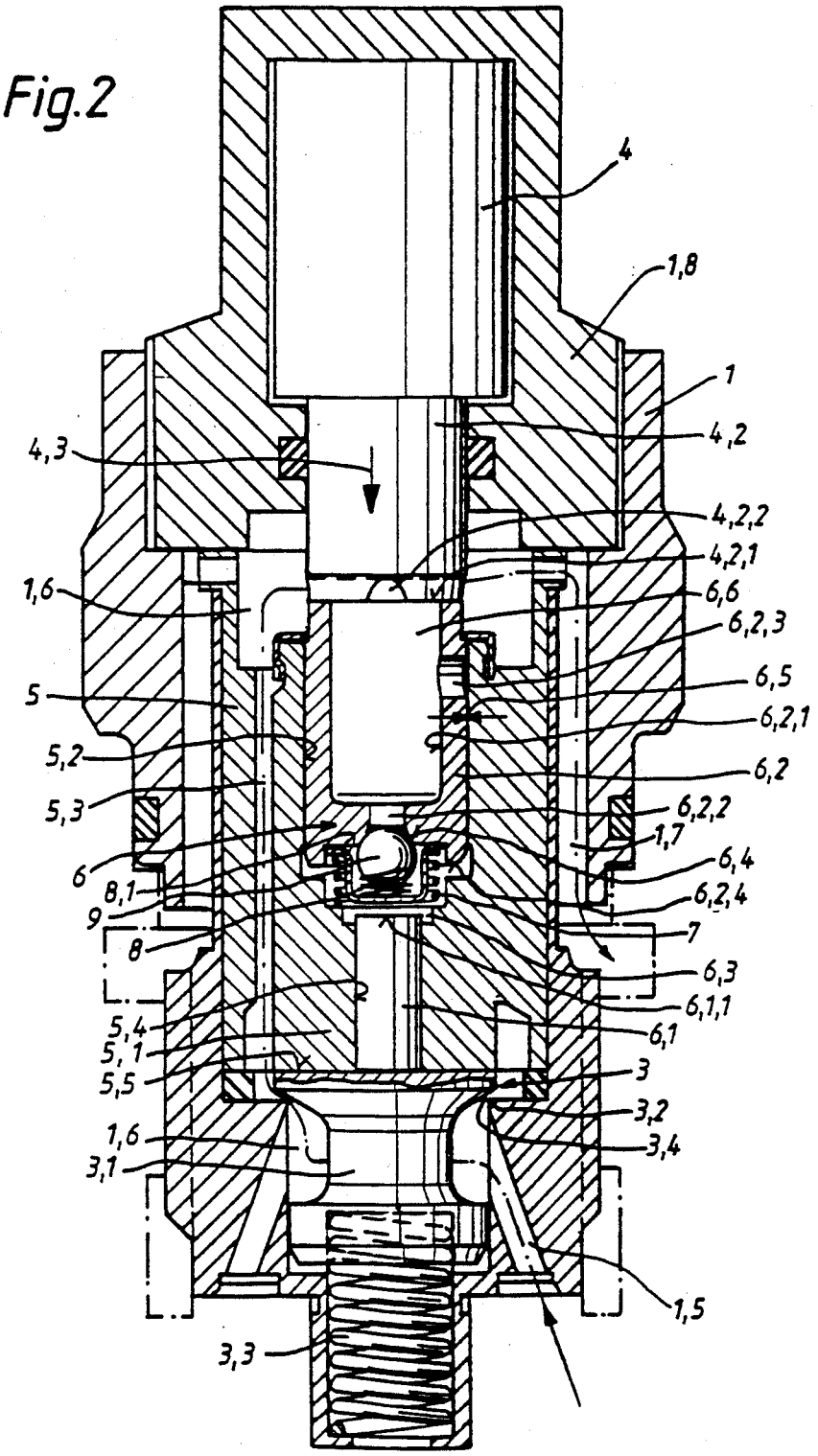
FIG. 2 is an enlarged representation the piezoelectric control valve according to the detail "II" in FIG. 1.

The detail II in FIG. 1 is shown enlarged in FIG. 2. At its lower end, the guide sleeve 5 firmly inserted into the space 1.6 of the housing 1 has a shoulder 5.1 which serves as an abutment 5.5 for the valve body 3.1 loaded by the spring 3.3. In the area of the valve body 3.1, the housing 1 has a valve seat 3.2. A gap 3.4 is formed between the valve seat 3.2 and the valve body 3.1 through which the motor fuel can flow into the return fluid channel 1.7 via the channels 5.3.

The play-compensation element 6 has a tappet cylinder 6.2 with a bore 6.2.1 and a bore 6.2.2 of smaller diameter adjoining the latter. The tappet cylinder 6.2 is movably guided in the axial direction in a bore 5.2 of the guide sleeve 5. The valve piston 6.1 is movably guided in the axial direction in a bore 5.4 of the guide sleeve 5. The bore 5.4 has a substantially smaller diameter and adjoins the bore 5.2 in the axial direction. The valve piston 6.1 rests with its lower end on the valve body 3.1. The upper end of tappet cylinder 6.2 bears on the end face 4.2.1 of the tappet 4.2 of the piezoelectric actuator 4 under the action of the force of a compression spring 7 which is supported between the base of the bore 5.2 of the guide sleeve 5 and a spring cage 8.1 on the lower end of the tappet cylinder 6.2. Both the compression spring 7 and the spring cage 8.1 are arranged in a chamber 6.3 formed by the lower end of the tappet cylinder 6.2 and the lower part of the bore 5.2 and also the end face of the valve piston 6.1. Inside the spring cage 8.1 is a further compression spring 8 which presses a valve ball 9 against a sealing seat 6.4 formed on the bore 6.2.2 of the tappet cylinder 6.2. The compression spring 8 has a substantially softer spring characteristic compared to that of the compression spring 7.

Between the outside diameter of the tappet cylinder 6.2 and the inside diameter of the bore 5.2 of the guide sleeve 5, there is a very narrow gap 6.5 which runs from the chamber 6.3 up to a bore 6.2.3 in the tappet cylinder 6.2. The bore 6.2.3 connects the chamber 6.3 filled with the motor fuel to the chamber 6.6 formed by the bore 6.2.1 in tappet cylinder 6.2 and the end face 4.2.1 of the tappet 4.2. A motor fuel can also pass into the chamber 6.6 via grooves 4.2.2 formed on the end face 4.2.1 on the tappet 4.2.

The mode of operation of the piezoelectric control valve is now as follows: With the piezoelectric actuator 4 and its tappet 4.2, in the shown inoperative position and that when the pump plunger 2 is actuated in the direction 2.1, the motor fuel can flow from the fluid channel 1.5 through the gap 3.4 at the valve 3 and the channels 5.3 in the guide sleeve 5 to the fluid return channel 1.7. If the piezoelectric actuator 4, working in an extending manner, is now energized by an impulse, its tappet 4.2 moves by about 50 micrometers in the direction 4.3 in about 50 microseconds. As a result of this movement, the tappet cylinder 6.2 and via the chamber 6.3 filled with motor fuel the valve piston 6.1 are also axially displaced in the direction 4.3. This axially displaces the valve body 3.1 in the direction 4.3, moving the valve body 3.1 against the valve seat 3.2 and closing the gap 3.4 interrupting the motor fuel flow.

During the further movement of the pump plunger 2 in the direction 2.1, the pressure in the fluid channel 1.5 and the nozzle space 1.4 now increases and thus the pressure acting on the nozzle needle 10 also increases. The needle valve spring 10.1 is designed so that the nozzle needle 10, at any minimum pressure set—for example from 300 bar—lifts from the injection bore 1.9. As a result, motor fuel is injected into the combustion chamber, with the pressure increasing to about 2000 bar during the injection operation.

Whereas the tappet 4.2 and the tappet cylinder 6.2 are moved only by the working stroke (50 micrometers) of the piezoelectric actuator 4, the valve piston 6.1 is moved by a greater stroke, namely the working stroke multiplied by a factor which corresponds to the ratio of the end face 6.2.4 of the tappet cylinder 6.2 to the end face 6.1.1 of the valve piston 6.1. This hydraulic stroke transmission therefore results in an increase in the stroke of the valve body 3.1, whereby correspondingly changes of cross-sections of flow are obtained at the valve gap 3.4. Moreover, it is advantageous that, apart from the tappet cylinder 6.2, only the valve piston 6.1, which has a comparatively low mass, needs to be accelerated.

If the piezoelectric actuator 4 is now de-energized by the cessation of the impulse, the tappet 4.2 moves back into the inoperative position within 50 microseconds. The duration of a working cycle, that is, between two energizing impulses, due to the system is a maximum of 0.5 milliseconds and the regulating time of the piezoelectric actuator, that is, the closing and opening duration, is about 0.1 milliseconds. By the force of the valve spring 3.3 and the pressure still acting on the valve body 3.1 via the fluid channel 1.5, the valve body 3.1 is moved upwards. The tappet cylinder 6.2 is also moved upwards by the valve body 3.1 via the valve piston 6.1 and the motor fuel cushion in the chamber 6.3 and the restoring force of the compression spring 7. The gap 3.4 is opened so that the pressure drops back to the system pressure, and the system becomes pressureless only after the delivery stroke of the pump plunger 2 is complete.

The inoperative position assumed by the tappet 4.2 may no longer correspond to the previous initial position, since, for example on account of piezoceramic setting actions—which can also be "elastic"—the length of the piezoceramic has shortened. Thus the end face 4.2.1 of the tappet 4.2 serving as a bearing surface for the tappet cylinder 6.2, in its present inoperative Position, lies above its initial position. If this shortening occurs, the compression spring 7 causes the tappet cylinder 6.2 to follow upwards in the axial direction until it again comes to bear on the end face 4.2.1. However, the volume in the chamber 6.3 also increases during this follow-up action so that an underpressure develops in this chamber 6.3. As a result, the valve ball 9 lifts from its sealing seat 6.4 against the force of the compression spring 8. Consequently, motor fuel is drawn out of the chamber 6.6 through the bore 6.2.2 into the chamber 6.3 until the chamber 6.3, now enlarged, is again filled with motor fuel. Once the pressure between the two chambers 6.3 and 6.6 is compensated, the valve ball 9 closes again under the force of the spring 8. Thus clearly defined conditions again exist for a renewed injection operation.

The inoperative position assumed by the tappet 4.2 may also no longer correspond to the previous initial position, since, for example on account of changes in the piezoceramic, the length of the same has increases. Thus the end face 4.2.1 of the tappet 4.2 acting as a bearing surface for the tappet cylinder 6.2, in its present inoperative position, lies below its initial position. If this lengthening occurs, a positive pressure still prevails in the chamber 6.3 which is brought about by the tappet cylinder 6.2 and the valve piston 6.1, still under the action of the force of the valve spring 3.3 and the pressure acting on the valve body 3.1 via the fluid channel 1.5, being clamped between the tappet 4.2 on the one side and the valve body 3.1 on the other side. This Positive pressure can now be reduced via the gap 6.5 until pressure is balanced which happens when the valve body 3.1 bears on the abutment 5.5. The annular gap 6.5 has to be dimensioned such that a positive pressure can be reduced within at most the difference in time between the operating cycle duration and the regulating time. Therefore clearly defined conditions again exist for a renewed injection operation even when the piezoelectric ceramic is extended.

Figure 3:
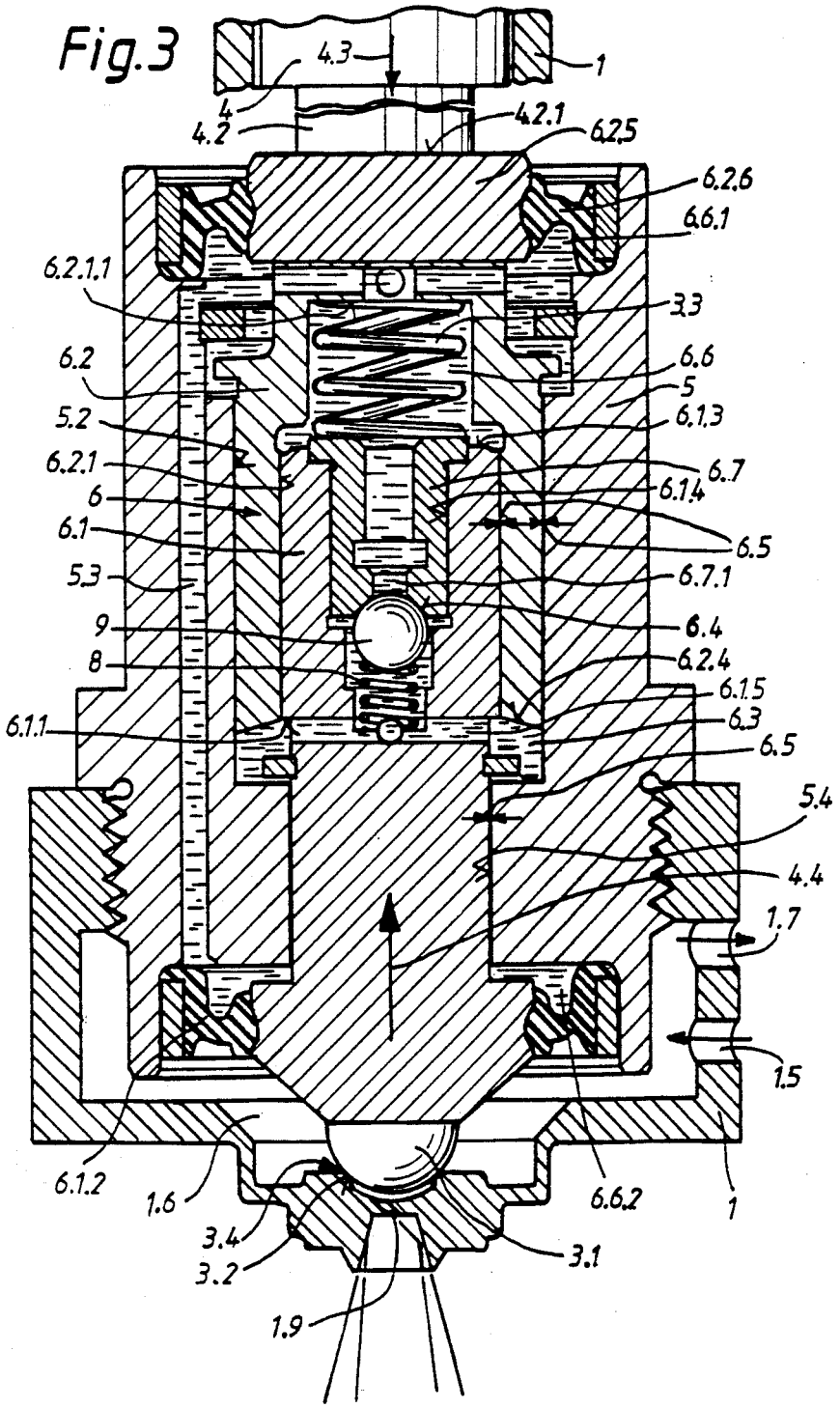
FIG. 3 is a cross-sectional view of a second exemplary embodiment of the subject matter of the invention.

The exemplary embodiment shown in FIG. 3 differs from that according to FIGS. 1 and 2 in that the piezoelectric actuator 4 with its tappet 4.2 and the valve piston 6.1 with the valve body 3.1 execute inverse movements 4.3, 4.4 relative to one another and the piezoelectric control valve is arranged in a low pressure circuit.

The guide sleeve 5, firmly inserted into the space 1.6 of the housing 1, has a stepped bore 5.2, 5.4 into which the play-compensation element 6 is inserted. At the upper end, the bore 5.2 is closed by a pressure plate 6.2.5 and a vulcanized-on sealing element 6.2.6. The pressure plate 6.2.5 bears on the end face 4.2.1 of the tappet 4.2. In the area of the valve body 3.1, the housing 1 has a valve seat 3.2. A gap 3.4 can form between the valve seat 3.2 and the valve body 3.1, and, through which gap 3.4, motor fuel can flow from the space 1.6 via the injection bore 1.9 into the combustion chamber or the suction pipe.

The play-compensation element 6 has a tappet cylinder 6.2 with a bore 6.2.1 and the pressure plate 6.2.5 and also a valve piston 6.1 with the valve body 3.1. The tappet cylinder 6.2 is guided in an axially movable manner in the bore 5.2 of the guide sleeve 5. The valve piston 6.1 is guided in an axially movable manner in bore 6.2.1 and in the bore 5.4 of the guide sleeve 5. The valve Piston 6.1, at its lower end, is connected to the guide sleeve 5 via a vulcanized-on sealing element 6.1.2. A valve spring 3.3, which is a compression spring, is supported between the base 6.2.1.1 of the bore 6.2.1 of the tappet cylinder 6.2 and the upper end face 6.1.3 of the valve piston 6.1. The valve spring 3.3 causes the valve piston 6.1 to rest with the valve body 3.1 on the valve seat 3.2, and the tappet cylinder 6.2 to bear with its pressure plate 6.2.5 on the end face 4.2.1 at the same time. The valve spring 3.3 is in a chamber 6.6 which is formed by the bore 6.2.1 and its base and the end face 6.1.3 of the valve piston 6.1 and is filled with oil. Moreover, a compression spring 8 and a valve ball 9 and also a closure sleeve 6.7 are arranged in a bore 6.1.4 made in the end face of the valve piston 6.1, 6.1.3. The bore 6.7.1 of closure sleeve 6.7 forming the chamber 6.6 is thus closed by the valve ball 9 interacting with the sealing seat 6.4 of the closure sleeve 6.7.

The length of the tappet cylinder 6.2 is dimensioned such that its annular end face 6.2.4 is still at a certain axial distance from the step formed in the transition area between the bore 5.2 and the bore 5.4. Moreover, the valve piston 6.1 is designed such that its part guided in the bore 5.4 has a smaller diameter than its part guided in the bore 6.2.1 so that an annular shoulder surface 6.1.1 is formed. In the inoperative position of the arrangement, the shoulder 6.1.1 comes into position above the end face 6.2.4. In the area of the shoulder surface 6.1.1, the valve piston 6.1 is provided with transverse bores 6.1.5 so that on the whole a chamber 6.3 filled with oil is formed between the valve ball 9 and the guide sleeve 5. When the valve ball 9 is lifted from the sealing seat 6.4, the chamber 6.3 is connected to the chamber 6.6.

A narrow gap 6.5, running from the chamber 6.3 to the chamber 6.6 and connecting the two chambers, is made between the outside diameter of the valve piston 6.1 and the inside diameter of the bore 6.2.1 of the tappet cylinder 6.2.

A further gap 6.5 is provided between the tappet cylinder 6.2 and the bore 5.2 of the guide sleeve—which connects the chamber 6.3 to a subchamber 6.6.1 of the chamber 6.6—and between the valve piston 6.1 and the bore 5.4 of the guide sleeve 5—which connects the chamber 6.3 to a subchamber 6.6.2 of the chamber 6.6. The two subchambers 6.6.1 and 6.6.2 are connected to one another by channels 5.3 in the guide sleeve 5 and are likewise filled with oil.

The mode of operation of the piezoelectric control valve is now as follows:

The piezoelectric actuator 4 with its tappet 4.2, is located in the shown inoperative position so that the motor fuel delivered by a motor fuel pump can fill the space 1.6 via a fluid channel 1.5 and can flow into the fluid return channel 1.7. If the piezoelectric actuator 4 working in an extending manner is now energized by an impulse, its tappet 4.2 moves by about 50 micrometers in the direction 4.3 in about 50 microseconds. As a result of this movement, the tappet cylinder 6.2 is also axially displaced to the direction 4.3 and, by the oil located in the chamber 6.3, the valve piston 6.1 and with it the valve body 3.1 are axially displaced in the inverse direction 4.4 to the direction 4.3. As a result, the valve body 3.1 lifts at the valve seat 3.2 and opens the gap 3.4 so that the motor fuel is delivered via the injection bore 1.9 into the suction pipe or the combustion chamber.

Whereas the tappet 4.2 and also the tappet cylinder 6.2, are moved only by the working stroke (50 micrometers) of the piezoelectric actuator 4, the valve piston 6.1 is moved by a greater stroke, namely by the working stroke multiplied by a factor which corresponds to the quotient of the annular end face 6.2.4 of the tappet cylinder 6.2 and the annular shoulder face 6.1.1 of the valve piston 6.1. This hydraulic stroke transmission and reversal of movement incorporated in the design therefore result in an increase in the stroke of the valve body 3.1, whereby correspondingly larger cross-sections of flow are obtained at the valve gap 3.4.

If the piezoelectric actuator 4 is now de-energized by the cessation of the impulse, the tappet 4.2 moves back into its inoperative position within 50 microseconds. By the force of the valve spring 3.3, the valve body 3.1 and the valve piston 6.1 are moved in the direction 4.3, and the tappet cylinder 6.2, via the oil cushion in the chamber 6.3 and the restoring force of valve spring 3.3, is also moved in the direction 4.4. Thus, the gap 3.4 is closed again and the motor fuel is delivered into the return channel 1.7.

The inoperative position assumed by the tappet 4.2 may no longer corresponds to the previous initial position, since the length of the piezoceramic has shortened and thus the end face 4.2.1 of the tappet 4.2, serving as a bearing surface for the tappet cylinder 6.2, in its present inoperative position, lies above its initial position. If this occurs, the action of the compression spring 3.3 causes the tappet cylinder 6.2 to follow up upwards in the axial direction 4.4 until it again comes to bear on the end face 4.2.1. During this follow-up action, however, the volume in the chamber 6.3 also increases so that an underpressure develops in this chamber 6.3. As a result, the valve ball 9 lifts from its sealing seat 6.4 against the force of the compression spring 8. Consequently, oil is sucked out of the chamber 6.6 through the bore 6.7.1 into the chamber 6.3 until the chamber 6.3, now enlarged, is again filled with oil. Once the pressure between the two chambers is compensated, the valve ball 9 closes again under the force of the spring 8. Thus clearly defined conditions again exist for a renewed injection operation.

The inoperative position assumed by the tappet 4.2 may no longer correspond to the previous initial position, since, the length of the same has increased and thus the end face 4.2.1 of the tappet 4.2 serving as a bearing surface for the tappet cylinder 6.2, in this present inoperative position lies below its initial position. If so, a positive pressure still prevails in the chamber 6.3 which is brought about by the tappet cylinder 6.2 and the valve piston 6.1 with the valve body 3.1, still under the action of the force of the valve spring 3.3, being clamped between the tappet 4.2 on the one side and the valve seat 3.2 on the other side. This positive pressure can now be reduced via the gap 6.5 until pressure is balanced, which happens when the pressure conditions in the chambers 6.3, 6.6, 6.6.1 and 6.6.2 are compensated.

The annular gap 6.5 has to be dimensioned such that a Positive pressure (this state is relatively uncritical since it is dampened and compensated via the sealing elements 6.1.2 and 6.2.6) can be reduced. Therefore clearly defined conditions again exist for a renewed injection operation even when the piezoelectric ceramic is extended.

Figure 4:
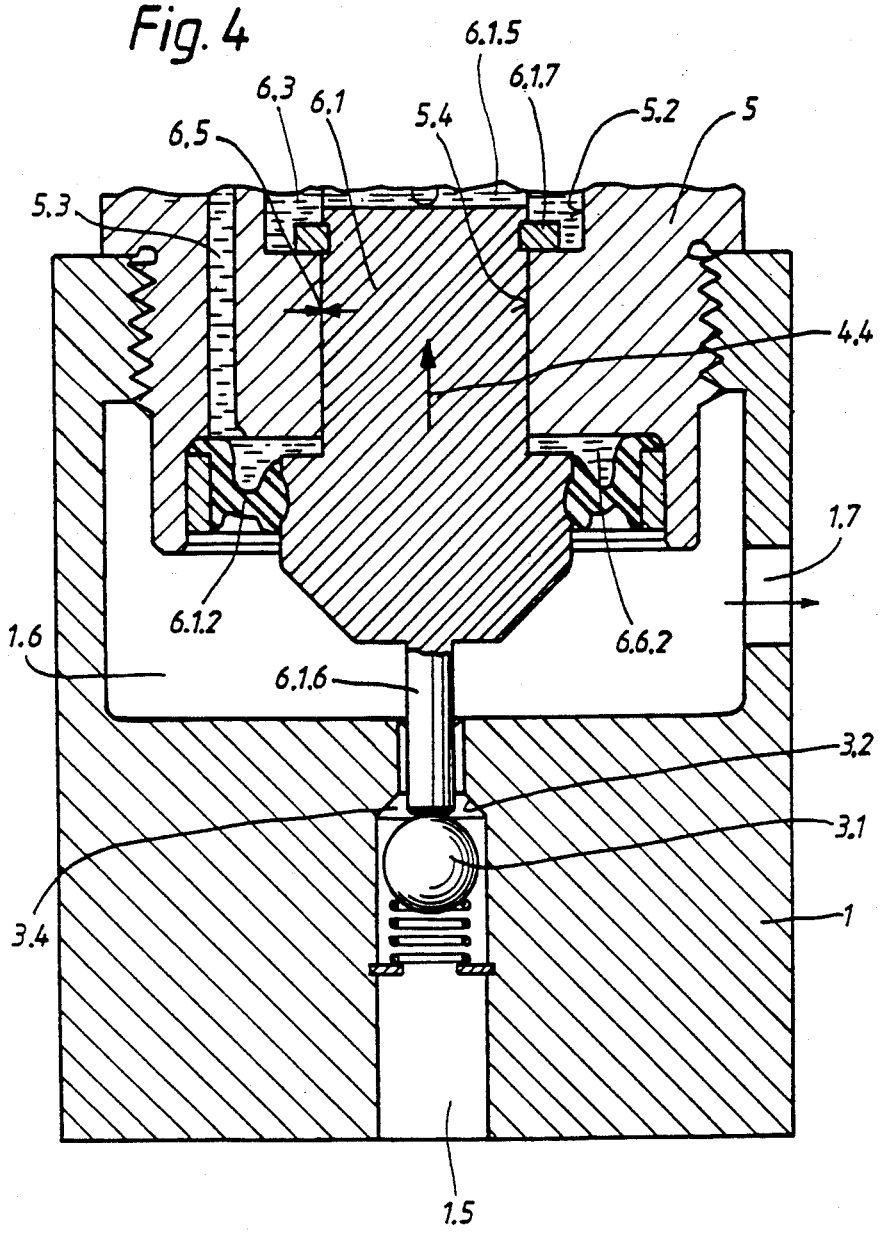
FIG. 4 is a cross-sectional view of a third exemplary embodiment of the subject matter of the invention.

The piezoelectric control valve shown in FIG. 4 corresponds to the greatest possible extent to that according to FIG. 3 and is only of a different design in the valve area, wherein the piezoelectric control valve is in turn arranged in the high pressure circuit—as in FIGS. 1 and 2.

In the area of the fluid channel 1.5, which leads into the space 1.6, the housing 1 has a valve seat 3.2, wherein a gap 3.4 is formed between the valve seat 3.2 and the valve body 3.1, through which gap 3.4 motor fuel can flow from the fluid channel 1.5 into the return fluid channel 1.7. In the inoperative position of the piezoelectric control valve, wherein the valve piston 6.1, via a stop 6.1.7, abuts in the bore 5.2 of the guide sleeve 5, the gap 3.4 is opened, since a shank 6.1.6 of the valve piston 6.1 lifts the valve body 3.1 from the valve seat 3.2. This prevents pressure from building up in fluid channel 1.5 and nozzle 10 stays close against injection bore 1.9. On the other hand, if the piezoelectric actuator is energized, the valve piston 6.1 moves upwards in the direction 4.4 so that, on account of the pressure in the fluid channel 1.5, the valve body 3.1 is pressed against the valve seat 3.2, closes the gap 3.4 and interrupts the connection between the return fluid channel 1.7 and the fluid channel 1.5 for pressure build-up in the same. This moves the nozzle needle 10 off injection bore 1.9.

Although the present invention has ben described and illustrated in detail, it is to be clearly understood that the same is by way of illustration and example only, and is not to be taken by way of limitation. The spirit and scope of the present invention are to be limited only by the terms of the appended claims.

What is claimed:

1. Piezoelectric control valve for controlling a motor fuel injection via an injection valve in internal-combustion engines, consisting of a piezoelectric actuator, arranged coaxially in a housing, and—connecting a fluid channel of the housing—a valve which has a valve seat and a valve body which is acted upon by a valve spring and which, via a valve piston displaceably guided in a first bore of a guide sleeve firmly arranged in the housing, interacts with a tappet cylinder, which can be moved by the piezoelectric actuator, via a fluid located in a chamber formed between the valve piston and the tappet cylinder, wherein an end face of the valve piston, for the purpose of a stroke transmission, is made smaller than an end face of the tappet cylinder, including a hydraulic play-compensation system, in the housing coaxially to and between the piezoelectric actuator and the valve body which move in the same direction, and the tappet cylinder displaceably guided in a second bore of the guide sleeve and provided with an axially running throughbore, said hydraulic play compensation system including:

a first compression spring, supported between the base of the second bore and a spring cage on the lower end of the tappet cylinder, and, inside the spring cage, a valve ball, closing the throughbore via a second compression spring, all are in the chamber filled with motor fuel and formed by the lower end of the tappet cylinder, the lower part of the second bore and the end face of the valve piston displaceably guided in the first bore of the guide sleeve adjoining the second bore;

the chamber, via a gap between the guide sleeve and the tappet cylinder and a third bore, is connected to the throughbore which can likewise be filled with motor fuel; and the tappet cylinder bears on an end face, provided with grooves, of a tappet of the piezoelectric actuator, and the valve piston bears on the valve body.

2. Piezoelectric control valve according to claim 1, wherein said valve seat for the valve body, having a gap therebetween, is on the housing in the area of the fluid channel, wherein, when the piezoelectric actuator is energized, the valve body closes the gap and interrupts the connection between a return fluid channel and the fluid channel for pressure build-up in the fluid channel.

3. Piezoelectric control valve according to claim 1, wherein the throughbore includes a first and a second bore, the first throughbore having a substantially smaller diameter and a shorter length than the second throughbore of the tappet cylinder.

4. Piezoelectric control valve according to claim 1, wherein the second compression spring has a substantially softer spring characteristic than the first compression spring.

5. Piezoelectric control valve according to claim 3, wherein the third bore in the upper part of the tappet cylinder, but still within the guide area in the guide sleeve, leads into the second throughbore.

6. Piezoelectric control valve according to claim 2, including guide channels in the guide sleeve connecting the fluid channel to the return fluid channel via the gap.

7. Piezoelectric control valve for controlling a motor fuel injection via an injection valve in internal-combustion engines, consisting of a piezoelectric actuator, arranged coaxially in a housing, and a valve connecting a fluid channel of the housing which has a valve seat and a valve body which is acted upon by a valve spring and which, via a valve piston displaceably guided in a first bore of a guide sleeve firmly arranged in the housing, interacts with a tappet cylinder, which can be moved by the piezoelectric actuator, via a fluid located in a first chamber formed between the valve piston and the tappet cylinder, wherein an end face of the valve piston, for the purpose of a stroke transmission, is made smaller than an end face of the tappet cylinder, including a hydraulic play-compensation system, in the housing coaxially to and between the piezoelectric actuator and the valve body which move in an inverse direction, to the piezoelectric actuator; said hydraulic play compensation system including the tappet cylinder displaceably guided in a second bore of the guide sleeve and provided with an axially running third bore, and the first chamber being filled with oil and formed by the lower end face, made in an annular shape, of the tappet cylinder, the lower part of the second bore and the end shoulder face, made in an annular shape, of the valve piston, also guided in the bore in an axially displaceable manner, and said first chamber being separated from a second chamber, formed by the third bore and the valve piston guided in said third bore and also filled with oil, by a valve ball loaded by a compression spring, which are arranged in the valve piston, and is connected via a gap between the valve piston and the tappet cylinder; and wherein said valve spring, supported between the base of the third bore and the valve piston, is in said second chamber, which valve spring holds the tappet cylinder in contact with an end face of a tappet of the piezoelectric actuator and holds the valve body in the inoperative position relative to the valve seat via the valve piston.

8. Piezoelectric control valve according to claim 7, wherein said valve seat for the valve body connected to the valve piston, having a first gap between the valve seat and the valve body, is on the housing in the area of the fluid channel, wherein, when the piezoelectric actuator is energized, the valve body opens the first gap and makes the connection between the fluid channel and an injection bore.

9. Piezoelectric control valve according to claim 7, including second gaps between the tappet cylinder and the guide sleeve in the area of the second bore and between the valve piston and the guide sleeve in the area of the first bore.

10. Piezoelectric control valve according to claim 9, including guide channels in the guide sleeve connecting said second chamber to a third chamber, into which the second gap between the valve piston and the guide sleeve leads.

11. Piezoelectric control valve according to claim 7, wherein the valve ball is pressed by the compression spring in the direction of the second chamber onto a sealing seat in the valve piston.

12. Piezoelectric control valve according to claim 7, wherein the valve seat of the valve body interacting with the valve piston, and having a first gap therebetween is on the housing in the area of the fluid channel, wherein, when the piezoelectric actuator is energized, the valve body closes the first gap and interrupts the connection between a return fluid channel and the fluid channel for pressure build-up in the fluid channel.

13. Piezoelectric control valve for controlling a motor fuel injection via an injection valve in internal-combustion engines comprising:

a control valve in a housing for controlling said injection valve;

a valve piston driving said control valve;

a tappet cylinder in said housing;

a piezoelectric driver for moving said tappet cylinder when energized;

a stroke transmission fluid chamber between said tappet cylinder and said valve piston for transmitting movement therebetween; and hydraulic play-compensating means connected to said stroke transmission fluid chamber for equalizing fluid pressure in said stroke transmission fluid chamber resulting from a change in the volume of said stroke transmission fluid chamber resulting from a return stroke of said piezoelectric driver.

14. Piezoelectric control valve according to claim 13, wherein said hydraulic play-compensating means includes a check valve for refilling said stroke transmission fluid chamber when the stoke of said tappet cylinder has been increased in said return stroke by a shortening of said piezoelectric driver.

15. Piezoelectric control valve according to claim 14, wherein said hydraulic play-compensating means includes restrictive passages parallel to said check valve for relieving high pressure in said stroke transmission fluid chamber when the stroke of said tappet cylinder has been decreased in said return direction by a lengthening of said piezoelectric driver.

16. Piezoelectric control valve according to claim 13, wherein said hydraulic play-compensating means includes restrictive passages for relieving high pressure in said stroke transmission fluid chamber when the stroke of said tappet cylinder has been decreased in said return direction by a lengthening of said piezoelectric driver.

17. Piezoelectric control valve according to claim 13, including a compression spring for biasing said tappet cylinder in a return direction.

18. Piezoelectric control valve according to claim 13, wherein the end face of said valve piston is smaller than the end face of said tappet cylinder to provide stroke transmission.

* * * * *